United States Patent [19]

Lee

[11] 4,297,164

[45] Oct. 27, 1981

[54] PROCESS FOR DISPLACEMENT WASHING OF POROUS MEDIA

[75] Inventor: Peter F. Lee, Auburn, Wash.

[73] Assignee: Weyerhaeuser Company, Tacoma, Wash.

[21] Appl. No.: 129,009

[22] Filed: Mar. 10, 1980

[51] Int. Cl.[3] ..... D21C 9/06

[52] U.S. Cl. ..... 162/60; 162/72; 8/156; 210/772

[58] Field of Search ..... 162/60, 72; 210/798, 210/772, 794; 8/156

[56] References Cited

U.S. PATENT DOCUMENTS

| | | | |
|---|---|---|---|
| 3,478,880 | 11/1969 | Harris | 210/794 |
| 3,567,574 | 3/1971 | Braitberg et al. | 162/60 |
| 3,697,438 | 10/1972 | Lieberman | 162/72 |

*Primary Examiner*—William F. Smith

*Attorney, Agent, or Firm*—Weyerhaeuser Company

[57] ABSTRACT

An improved displacement washing process for recovering processing chemicals from a porous medium, particularly wood pulp, is described. The effective mobility of a displacing solution, typically a more dilute solution of the chemical sought to be recovered, is reduced such that it is less than the mobility of the solution to be recovered. In a pulp mill washing system, consumption of wash water may be reduced 0.6 tons of water per ton of pulp produced without reducing chemical recovery. Conversely, chemical effluent from the washer could be reduced by 50% without increasing wash water requirement. Mobility is proportional to the permeability of the porous medium with respect to the solution of interest and inversely proportional to the viscosity of that solution. Mobility of the wash solution relative to the solution to be displaced is preferrably reduced by the addition of a soluble, high molecular weight polymer, greater than $10^6$, until the ratio of the mobility of the wash solution to that of the chemical rich solution is in the range of 0.05–2.0, preferably within the range of 0.2–1. As examples, copolymers of acrylamide and acrylic acid, carboxypolymethylene, polyacrylic acid and deacetylated chitin have been found to be effective in reducing mobility. The presence of 6–10 ppm of a copolymer of acrylamide and acrylic acid of MW greater than $10^6$ in the wash solution of a brownstock washer can double the efficiency of the washer.

23 Claims, 5 Drawing Figures

WITH 6-10 PPM POLYMER

PROCESS FOR DISPLACEMENT WASHING OF POROUS MEDIA

BACKGROUND OF THE INVENTION

1. Field of the Invention

The field of this invention is displacement washing of porous media. More particularly, the invention involves washing and bleaching of pulp fiber mats.

2. Description of the Prior Art

In the manufacture of many materials, particularly chemicals, it often becomes necessary to separate the components of a mixture by dissolving one or more of them from the processing mixture. A common process requires washing the mixture with a solvent in which one or more of the materials constituting the mixture is soluble and the material sought to be recovered is insoluble.

In pulp and paper manufacture, it is often necessary to wash the pulp to remove contaminants or recover processing chemicals. For example, after wood chips are digested in a chemical solution designed to dissolve lignin, thereby freeing the wood pulp fibers, it is necessary to separate the lignin bearing spent cooking liquor from the pulp. Recovery of the liquor is important economically as a means of recovering cooking chemicals and environmentally as a means of preventing water pollution.

Black liquor recovery or brownstock washing, as it is usually called, is most often accomplished by rotary-drum vacuum filters. These filters are generally arranged in a series of four, with countercurrent flow of wash fluid. A typical rotary-drum vacuum washer comprises a wire-cloth cylinder partially submerged in a slurry tank of fibers. The cylinder is provided with a vacuum which, as the drum rotates, causes the pulp to build up on the wire. A number of showers are located near the drum surface to direct wash solution onto the pulp as it travels about the drum. The pulp at a selected consistency then discharges from the drum to the next washing stage for subsequent processing.

The cost of energy and stringent effluent controls emphasize the need to minimize dilution of recovered chemicals during brownstock washing while maintaining a high level of chemical recovery. In many cases poor washing efficiency may be limiting production and thus the incentive to improve efficiency is high.

In commercial brownstock displacement washers, the displacing wash solution is usually a more dilute solution of the spent cooking liquor that is sought to be displaced from the fiber pad. There is appreciable mixing within the pulp and fiber matrix between the liquor and wash fluid during washing, primarily as a result of preferential penetration of the wash fluid in regions of the pad having higher permeability. Fingers or channels of penetrating wash fluid form in these areas of pad nonuniformities. These "fingers" have lower pressure drops along their length due to the lower viscosity of the wash fluid with respect to the liquor to be displaced. The lower pressure drop promotes growth of the fingers. As a result of the development of the fingers or channels of wash fluid, large regions of stagnant liquor are eventually by-passed. This phenomemon, termed herein "viscous fingering," is the primary mechanism adversely influencing the effectiveness of brownstock displacement washing.

The viscous fingering phenomenon was first described in relation to secondary recovery of petroleum by water or brine injection into oil bearing strata. As has long been practiced in the oil industry, recovery is improved by displacing the oil from its porous formation with water. If the natural pressure of the formation were relied on alone, a significant amount of oil would otherwise remain locked in the ground. Researchers found that one of the problems encountered in water injection was a tendency for the water to preferentially pass through larger pore openings of the oil bearing rock, bypassing the smaller passageways. As a consequence, the water or brine would tend to "finger" through the strata and bypass oil. In a search for injectable liquids that could do a better job of displacing oil, prior workers tried to match the "mobility" of the displacing fluid to that of the oil. Mobility is defined as a characteristic of a fluid in certain media related to the piston like capability of the fluid to displace a solution retained in media without the displacing fluid channeling through the solution-media.

A low viscosity fluid such as water or brine injected into a porous strata typically was discovered to have a higher "mobility" than the more viscous oil. Early attempts to use such materials as glycerine, sugar or glycols failed on the basis of economics. Workers in the field of secondary oil recovery subsequently discovered that certain polymers dissolved in water at low concentrations impart a reduced mobility to injected water with respect to the oil sought to be displaced. These polymers exhibit a far greater impact on the mobility of water in rock formations than the measured solution viscosity in a laboratory would indicate. See Jennings, U.S. Pat. No. 3,687,199.

The unusual ability to improve oil recovery is a property of only a few select water-soluble polymers. Among these are the extensive family of acrylamide polymers and copolymers. The use of certain of these high weight polymers in injection waters, particularly synthetic, partially hydrolyzed polyacrylamide solutions, substantially improves secondary and tertiary oil recovery, as is described in the petroleum recovery literature. See Pye, "Improved Secondary Recovery by Control of Water Mobility," J. Pet. Tech. 911, (August 1964).

Very dilute solutions of these particular polymers, at 250–500 ppm exhibit viscosities differing only slightly from water. However, flow of these solutions through a microporous medium such as sandstone may exhibit 5–10 times more displacement capacity than other solutions having much higher viscosities. Such performance is exhibited only in porous media having a pore structure that forces displacing fluids to travel a tortuous path in passing through them.

In Pye, Id. at 911, Darcy's law, describing the flow of fluids through porous media, is expressed as $$q = \frac{k\,\Delta p\,A}{\mu\,L}$$

wherein q = flow rate ($ft^3$/seconds); $\Delta p$ = pressure drop (lbs/ft-sec.$^2$); A = area ($ft^2$); L = thickness of the medium (ft); $\mu$ = fluid viscosity (lb/sec-$ft^2$); and k = permeability of the media to the fluid (ft.).

Fluid viscosity and its interaction with the permeability of the medium are characteristics which function as resistance factors to flow. The ratio of permeability to viscosity ($k/\mu$) for a particular system is often called the mobility, λ, of a fluid with respect to a particular medium.

The ratio of the mobility of a solvent to the mobility of a solution of the solvent containing a polymer, under equivalent conditions of fluid saturation and temperature has been termed by Pye the "resistance factor," R of the polymer solution. The resistance effect of a polymer where water is the solvent, is expressed in terms of mobilities, as:

$$R = \frac{\lambda_w}{\lambda_p} = \frac{k_w \mu_p}{\mu_w k_p}$$

As polymer is added, the mobility $\lambda_p = k_p/\mu_p$ of the displacement solution, flowing through the particular porous medium, is reduced. Consequently, the resistance factor of a system, that is, the flowing properties of the solution without the polymer relative to the flowing properties of the solution with the polymer, is increased. The observed effect of the polymer addition is that the treated solution does a significantly improved job of displacing a viscous fluid retained in a porous medium than an untreated displacing solution. The ability of a displacing wash liquid to displace a viscous liquor from a porous medium increases as its mobility with respect to that porous medium is reduced.

SUMMARY OF THE INVENTION

In brief summary, the invention is an improved process for recovering processing chemicals from porous media, such as, for example, recovering spent black liquor from wood pulp by displacement washing. The process of the invention requires reducing the mobility of the wash solution so that it is less than the mobility of the solution sought to be recovered, wherein mobility is proportional to the permeability of the porous medium to the solution of interest and inversely proportional to the viscosity of that solution. A 0.05–2.0 ratio of wash solution mobility to the mobility of the solution to be recovered substantially improves chemical recovery for a given quantity of wash water. The preferred range of the mobility ratio is 0.2–1.0.

Any substance or change of physical conditions that establishes a mobility ratio within the 0.05–2.0 range and that is compatible with the system and substances of interest is within the scope of the invention. A change in processing conditions, such as, for example, a reduction in temperature decreasing the viscosity of the displacing fluid is sometimes sufficient to attain the proper mobility ratio. The principal method of the invention requires the addition of a chemical substance to increase the viscosity or to, in effect, reduce the permeability of the porous media with respect to the washing fluid.

A number of starches and modified ethylene glycols are suitable for mobility reduction, primarily through viscosity increases. The identification of these viscosity modifiers is within the capability of one skilled in the chemical arts.

A preferred process requires the addition of polymers that principally affect the permeability of the wash solution with respect to the media within which the liquid to be displaced is held. Examples of polymers in this group include copolymers of acrylamide and acrylic acid, carboxypolymethylene, poly acrylic acid and deacetylated chitin. A preferred polymer is the copolymer of acrylamide and acrylic acid having a molecular weight greater than $10^6$.

The preferred polymer addition may be in the range of 2–200 ppm with the minimum amount necessary being used to accomplish the required range of mobility ratios. For the preferred copolymer of acrylamide and acrylic acid, a 6–10 ppm addition to the wash solution of a brownstock washer doubles the efficiency of the washer in displacing 2.39 cp kraft black liquor from wood pulp.

The effect of the mobility modification is to reduce the amount of wash solution required to displace a chemical laden solution to a selected yield. Alternatively, substance yield of the dissolved solids may be increased without increasing dilution of the solution ultimately recovered.

The carry-over of chemicals from the washing operation into bleaching stages can be decreased substantially, for example from 2.2% to 1.1%. In terms of economics, for the typical 1000 tons per day pulp mill, savings in chemical consumption may amount to more than $1 million per year. The additional increment of recovery may be extremely important in pollution control schemes where the last fractional percentage recovery of pollutants tends to be exceedingly expensive.

It is an object of the present invention to provide, in displacement washing of pulp, a process for improving chemical recovery at the brownstock washers. The effect is to minimize chemical consumptions for bleaching downstream and effluent BOD, color and toxicity.

The benefits of the process of the invention may be realized as a reduction in wash water requirements. Less steam is needed to evaporate waste liquor resulting in savings of approximately $3,000 per day at current energy costs for a 500 ton per day pulp mill. Polymer costs would be on the order of $85/day. These benefits are possible with no modification of existing washing equipment or substantial capital cost.

DETAILED DESCRIPTION OF THE INVENTION

It has been discovered that the principles employed in secondary oil recovery may be utilized in improving displacement washing recoveries from the much thinner strata or porous media found in the chemical process industry. The new process is particularly advantageous for recovering spent cooking liquor and bleaching chemicals from pulp and paper processes.

The addition of minute quantities of certain high molecular weight polymers to a wash solution or liquor can appreciably decrease the mobility of that liquor with respect to the more concentrated liquor to be recovered. Channeling or viscous fingering in a fiber pad is retarded if the mobility of the wash liquor can be decreased below that of the fluid to be displaced. When wash fluid begins to penetrate a region of high permeability in the pad, the region becomes filled with the wash liquid which has a lower mobility than the solution to be displaced and the channeling penetration is retarded.

Figure 1:
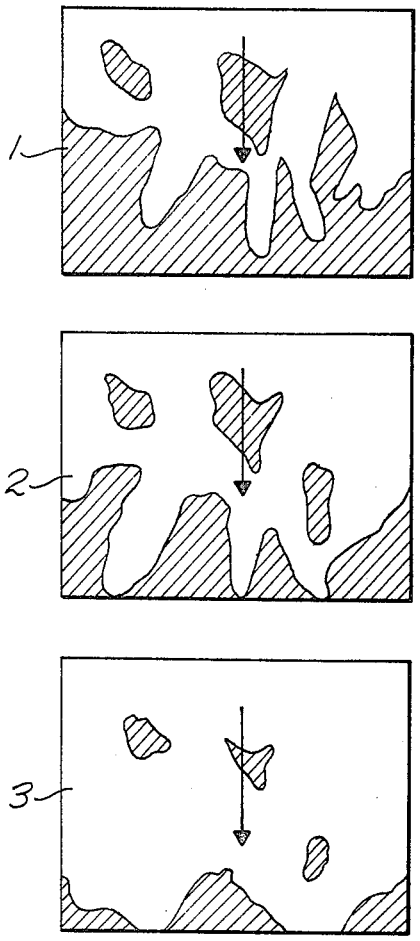
Fig. 1 PRIOR ART
FIGS. 1 and 2 are schematic representations of the effect of polymer addition on channeling or viscous fingering in comparison with the prior art.
Figure 2:
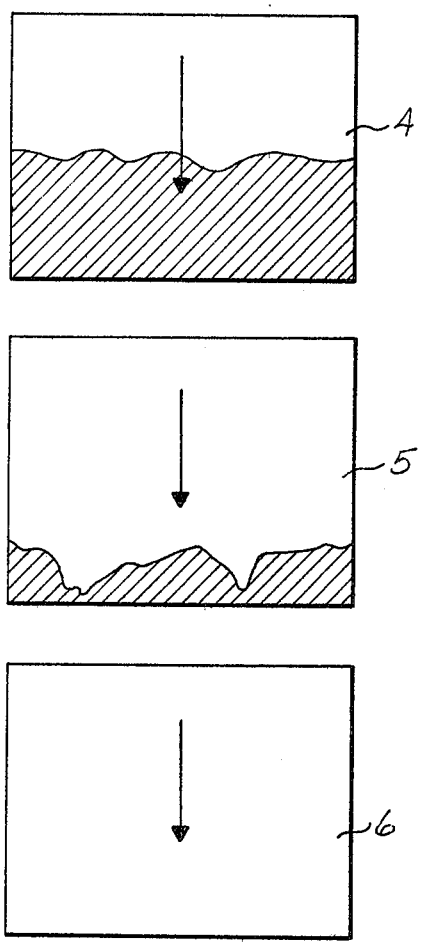

The viscous fingering which occurs during the displacement of concentrated spent cooking liquor with a less concentrated wash liquor is illustrated in FIG. 1. FIGS. 1 and 2 present a series of drawings illustrating the longitudinal dispersion of two fluids in a porous medium at different stages of washing with and without polymer added to the wash fluid. Viscous fingering is shown to be less in the case where polymer has been added to the wash fluid.

Referring to FIGS. 1 and 2, illustrations 1 and 4 compare displacement washing results in a pulp pad at a dilution factor (defined below) of −4, where the weight of wash liquor added is only 55% of the weight of the original liquor in a fiber pad at 10% consistency. Despite the much greater longitudinal mixing in the case without polymer, none of the fingers of wash liquor have penetrated the entire pad depth and the displaced liquor has the same concentration as the original liquor. In terms of externally measured variables, both systems exhibit perfect displacement.

As dilution factor increases above −4.0, illustrations 2 and 5, fingers of wash liquor with no polymer added penetrate the full depth of the pad with increasing frequency and more and more wash liquor dilutes the displaced fluid. Viscous fingering is now manifested in terms of lower displacement ratios than those predicted for ideal displacement. At dilution factors less than −4.0, none of the wash fluid with polymer added, illustration 5, has penetrated the pad and in terms of externally measured variables displacement still appears perfect.

At a dilution factor of +4.0, illustration 3 and 6, the wash liquor with polymer added completely displaces the original liquor, whereas, when no polymer is used, pockets of the original liquor are bypassed and remain unrecovered.

EXAMPLE 1

Pads of unbeaten, unbleached kraft pulp fibers were formed on a Buchner funnel by filtration from a suspension in spent sulfate cooking liquor. The resultant pads had basis weights of approximately 1,000 g/m$^2$ and fiber concentrations of around 3.75%.

To recover the liquor entrained in the pad, water or dilute polymer solutions of known concentration and viscosity were carefully poured through a course wire screen onto the top of the fiber pads. The entrained liquors were displaced under gravity and the underflows sampled continuously. Washing was discontinued when practically all of the entrained liquors had been displaced. For each sample, the solids content and the cumulative volume displaced were measured. These results were expressed in terms of cumulative substance yield and dilution factor. Cumulative substance yield is defined as the percent of recovery of the total amount solids retained in the pad. Dilution factor is defined as the weight of wash fluid added to the pad in excess of the liquor originally retained in the pad after dewatering, per unit weight of fiber. According to this definition, dilution factor is negative if the weight of wash fluid is less than the weight of liquor originally in the pad.

In a series of experiments, black liquor was displaced from the fiber pads using distilled water and dilute solutions of carboxypolymethylene.

The experiments were performed at either 20° C. or 60° C. In some cases, air was drawn through the pad prior to displacement.

Figure 3:
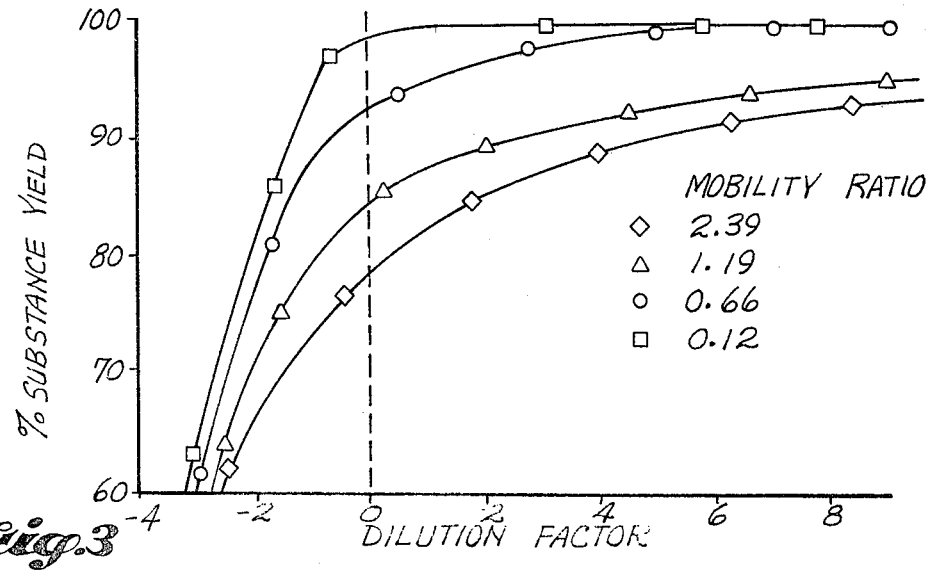
FIG. 3 shows the effect on substance yield of adding polymer to wash solutions to reduce mobility ratio, as a function of dilution factor.

Under all experimental conditions tried, the addition of small quantities of soluble polymer to the wash fluid markedly increased the displacement efficiency. Typical results are presented in FIG. 3 as a graph of substance yield vs. dilution factor. It can be seen that under the conditions of these experiments, decreasing the mobility ratio, that is, the ratio of wash solution mobility to that of the solution to be recovered, from 2.39 to 0.12 increased substance yield at zero dilution factor from 78% to 98%.

EXAMPLE 2

Trace amounts of a high molecular weight non-ionic polyacrylamide (DOW XD 30150-00), manufactured by Dow Chemical Company of Midland, Mich., were added to wash fluid in a laboratory simulation of a commercial brownstock washer. The spent cooking liquor in these tests was red liquor from a sulfite cook.

All phases of washing which occur during each revolution of a typical brownstock washer were simulated under controlled laboratory conditions. The apparatus used was a filter comprising a cylinder 10.6 cm in diameter and approximately 5 cm in length. One end of the cylinder was covered with a wire screen. The opposite end was closed and connected via a liquid trap to a source of vacuum. A circular rim 2 cm high extended about the periphery of the open surface of the wire screen. The vacuum in the laboratory filter was adjusted to duplicate that of a mill drum washer. The filter was immersed in an agitated suspension of softwood sulphite fibers and spent sulfite cooking liquor (red liquor) for the same length of time as the period of immersion on the drum washer. Both the wood pulp fibers and liquor were obtained from the number one brownstock washer at Weyerhaeuser Company's Cosmopolis mill.

After pad formation, the filter was removed from the suspension and the resultant pad was allowed to drain under vacuum prior to washing. A quantity of dilute spent cooking liquor, corresponding to the volume per unit area sprayed onto the industrial washer, was poured onto the surface of the fiber pad and drawn through under vacuum.

A large volume of pure water was then drawn through the pad to recover the residual red liquor solids not displaced during the washing phase.

Measurements were made of the volume and solids content of the wash liquor, the liquor displaced during washing and the liquor displaced during the final rinse.

The experimental conditions were chosen to match those on the actual washer which are typically as follows:

(i) drum emersion=60%; (ii) drum speed=2.4 rpm; (iii) total solids at inlet=12%; (iv) total solids in wash fluid=6%; (v) vacuum=250 mm Hg; (vi) temperature in vat=66° C.; and (vii) dilution factor of −4 to +5.

The simulation was repeated using varying quantities of wash liquor with and without the addition of 6–10 ppm of polyacrylamide.

Figure 4:
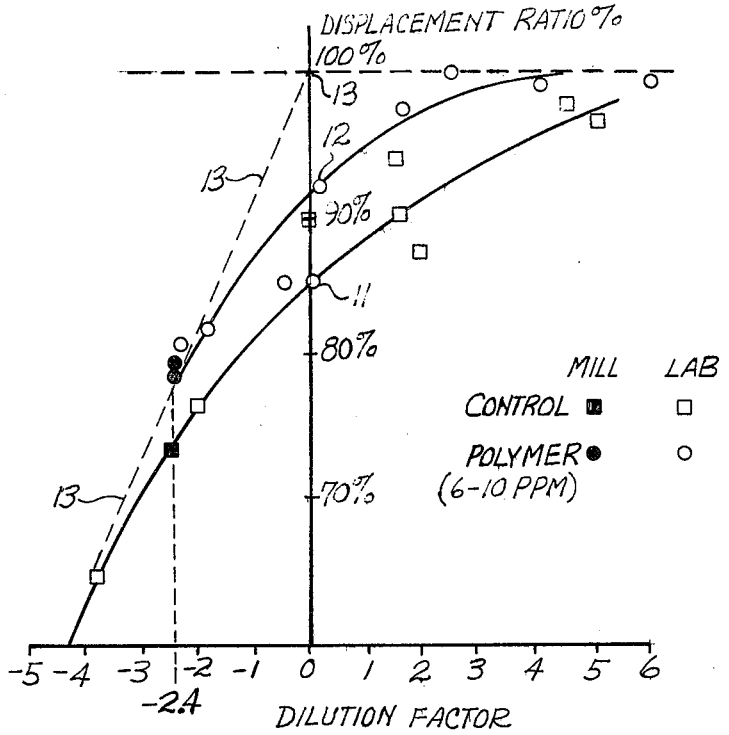
FIG. 4 is a graph showing the effect of polymer addition to wash solution on displacement ratio, as a function of dilution factor.

Referring to FIG. 4, a graph of displacement ratio, defined as the ratio of the weight of recovered solids to the weight of solids which could be recovered with perfect displacement, versus dilution factor, defined as the weight of wash fluid in excess of the weight of original liquor in the pad per unit weight of fiber, is shown.

It can be seen from FIG. 4 that the addition of a minute quantity of a high molecular weight polymer to the wash fluid can markedly increase the displacement efficiency over the complete range of dilution factors of practical interest. At zero dilution factor, the displacement ratio can be increased from 85% at point 11 to 92% at point 12 through the addition of polymer. That is, the residual, washable solids retained in the pad were approximately halved.

A line 13 representing perfect displacement has been included in FIG. 4 for reference. The position of this line was calculated assuming no longitudinal mixing between the original liquor and wash fluid.

The percentage reduction in undisplaced solids through the addition of polymer increased from zero at a dilution factor of −4 to 100% at a dilution factor in excess of +4 when displacement for the polymer system was complete. This behavior can be rationalized in terms of the concept of viscous fingering, as described above with reference to FIGS. 1 and 2.

EXAMPLE 3

Mill Trial

To further test the displacement washing advantages shown in the laboratory under actual mill conditions, a small quantity of a 0.17% solution of polyacrylamide, DOW XD-30150-00, manufactured by Dow Chemical Company of Midland, Mich., was metered into the main stream of wash fluid supplied to the number one brownstock washer at Cosmopolis such that the concentration of polymer in the main fluid was less than 10 ppm.

During the one-hour trial period, the operating conditions on the number one brownstock washer were maintained constant at:

(i) drum emersion=60%; (ii) drum speed=2.0 rpm; (iii) total solids in vat=14.64%; (iv) total solids in wash fluid=8.93%; (v) vacuum=250 mm Hg; (vi) temperature in vat=66° C.; (vii) temperature of wash fluid=56° C.; (viii) flow rate of wash fluids=2350 gpm (620 gpm); (ix) consistency of washed pad=8.88%; (x) throughput of fiber=20 T/hr.; and (xi) consistency in vat=1.0%. Under these conditions, the washer operated with a dilution factor of −2.4.

The concentrated polymer solution was injected into the pipe supplying wash fluid to the washer approximately one meter upstream from the header which distributes fluid to the shower nozzles. Turbulence within the pipe was assumed to be sufficient to evenly distribute the polymer throughout the main flow of wash fluid. The maximum rate of injection of polymer solution was only approximately 0.02% of the flow rate of wash fluid and its effect on dilution factor can be neglected.

Experiments were performed on the number one brownstock washer in order to measure the displacement efficiency with and without the addition of 6.05 and 9.33 ppm of polymers to the wash fluid. In each case polymer was added to the wash fluid for a period of approximately ten minutes. Multiple samples of the washed pulp were taken during this period of addition and, for purposes of comparison, during the ten-minute periods directly before and after the period of addition. Care was taken to always sample the washed pulp from the same point on the drum surface in order the minimize erroneous measurements resulting from any inconsistent variations in washing or drainage efficiency over the drum surface.

The concentrations of dissolved solids in the vat and in the wash liquor were 14.64 g solids/100 g liquor and 8.93 g solids/100 g liquor, respectively. Since the concentration of dissolved solids in the vat equals the concentration of dissolved solids in the pad prior to displacement, the maximum possible recovery of displaced solids corresponds to complete replacement of the original liquor in the pad with wash liquor. Consequently, in this case, the maximum possible recovery was 5.71 g solids/100 g liquor.

The concentrations of dissolved solids in the entrained liquors were measured. A tabulation of these results appears in Table A. The actual recovery of dissolved solids increased from 4.24 g solids/100 g liquor to 4.54 g solids/100 g liquor due to the addition of polymer. The recoveries due to the different levels of polymer concentrations were not statistically significant. The increases in recovery due to the addition of polymer are statistically significant to the 95% confidence level.

TABLE A

Displacement Data for Number One Washer

| Polymer Concentration (ppm) | Consistency of Pad % | Final Concentration of Dissolved Solids in Pad (g solids / 100 g liquor) | Reduction in Concentration of Dissolved Solids in Pad (g solids / 100 g liquor) |
|---|---|---|---|
| 0.00 | 8.729 | 11.12 | 3.52 |
| | 8.562 | 10.62 | 4.02 |
| | 8.849 | 10.50 | 4.14 |
| | 8.814 | 10.42 | 4.22 |
| | 9.429 | 10.32 | 4.32 |
| | 8.555 | 10.24 | 4.40 |
| | 9.631 | 10.24 | 4.40 |
| | 8.775 | 10.14 | 4.50 |
| | 8.912 | 9.95 | 4.69 |
| | Avg. 8.92 | Avg. 10.39 | 4.24 |
| 6.05 | 8.913 | 10.23 | 4.41 |
| | 8.571 | 10.05 | 4.59 |
| | 8.920 | 9.94 | 4.70 |
| | 8.72 | 10.07 | 4.57 |
| 9.33 | 8.425 | 10.24 | 4.40 |
| | 9.179 | 10.17 | 4.47 |
| | 9.353 | 10.13 | 4.51 |
| | 8.916 | 9.96 | 4.68 |
| | 8.97 | 10.13 | 4.51 |

The ratio of the actual recovery to the maximum possible recovery is termed displacement ratio. In this case the percentage displacement ratio increased from 74.2% to 79.5% due to the addition of polymer. In other words, the residual washable solids were reduced by 20%. These results have been combined with the appropriate dilution factor and superimposed on the results from the laboratory simulation of this washer presented in FIG. 4.

The mill data is in good agreement with predictions based on laboratory data. As expected, at a dilution factor of −2.4, displacement on the drum washer appeared to be perfect after the polymer had been added. It is impossible to achieve a displacement ratio greater than 78% at this dilution factor, since the weight of wash liquor added is only 78% of the weight of the original liquor.

The consistencies of the samples of fiber pads leaving the washer were measured. These results are also shown in Table A. There is no statistically significant difference between the consistencies of pad samples taken before and after the addition of polymer. It is concluded that, in this case, the polymer did not affect drainage through the pad on the washer.

Washer Efficiencies

In a drum washer, both displacement and "dilution and thickening" are used to separate pulp and spent cooking chemicals. Consequently, to predict the overall efficiency of a drum washer, it is necessary to consider both of the washing mechanisms and their interaction. However, once the displacement process is characterized, all of the pulp and liquor flows around a drum washer can be deduced from simple mass balances. The steady-state compositions and volumes of all flows around the washer can be deduced for a particular dilution factor using the empirical description of the displacement process together with a comprehensive series of simultaneous equations which describe the mass balances for each of the elemental processes of mixing, dilution and thickening.

For example, the data presented in FIG. 4 can be used to deduce the steady-state composition of all the streams around the number one washer. It should be noted that this level of analysis does not consider the interaction between washers. It does, however, enable the overall operation of a washer to be characterized.

A Nordeen Efficiency Factor, E, may be used to characterize washing efficiency. E is defined as the number of countercurrent ideal mixing stages in series that is required to achieve the same performance as the washer or plant being considered. Kommonen, "Pulp Washing Evaluation for Design and Operation," Papper Och Tra, 6:347 (1978). E can be calculated knowing inlet and outlet conditions using equation (1).

$$E = \frac{\ln\left(\frac{L_{pi}}{L_{po}} \cdot \frac{C_{pi} - C_{lo}}{C_{po} - C_{li}}\right)}{\ln \frac{L_{li}}{L_{po}}} \quad (1)$$

where L=liquor flow; C=concentration of dissolved solids; subscript "p" refers to pulp flow; subscript "l" refers to liquor flow; subscript "i" refers to inlet; and subscript "o" refers to outlet.

When $L_{li}=L_{po}$ and $L_{lo}=L_{pi}$, equation (1) becomes indeterminant, and equation (2) applies:

$$E = \left(\frac{L_{po}}{L_{pi}} \cdot \frac{C_{lo} - C_{li}}{C_{pi} - C_{lo}}\right) \quad (2)$$

Figure 5:
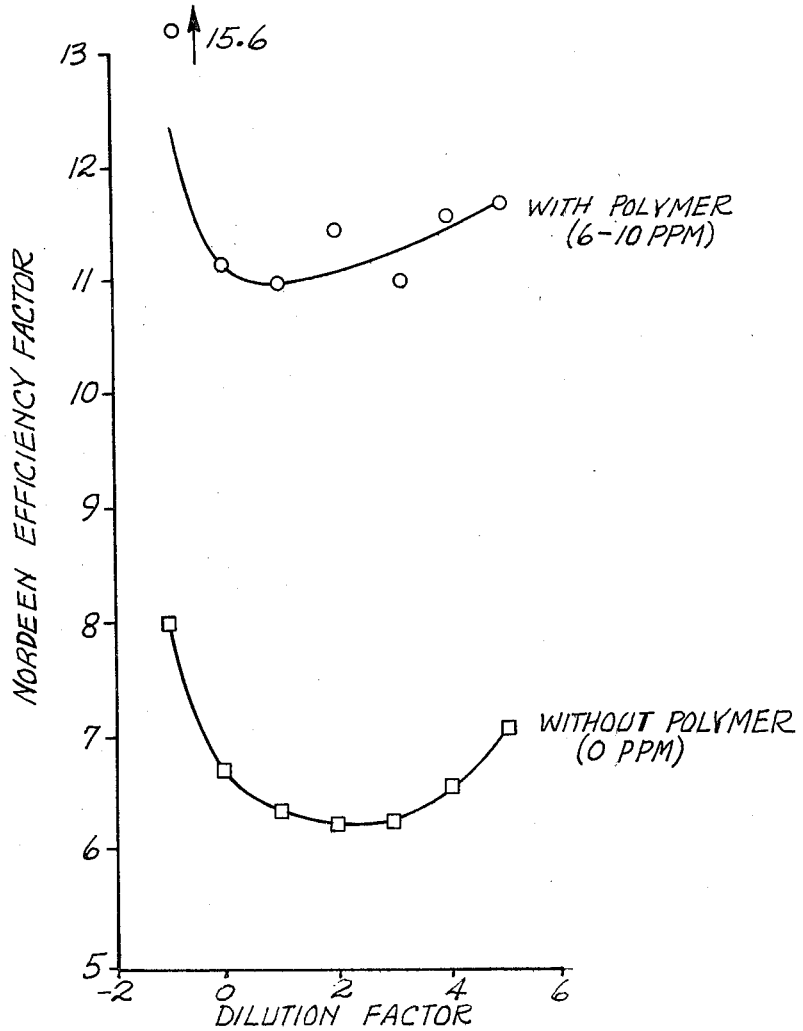
FIG. 5 is a graph of the effect of polymer addition to wash solution on displacement washing efficiency as a function of dilution factor.

Values of E which characterize the operation of the number one washer at Cosmopolis have been calculated for a wide range of dilution factors using equations (1) and (2) and are presented in FIG. 5.

FIG. 5 is a graph of the efficiency factor E versus dilution factor for the washer operating with and without polymer. Over a normal range of dilution factors (0 to 4), the value of E is not strongly dependent upon dilution factor. The Nordeen efficiency factor is approximately 6.4 without polymer and increases to approximately 11.5 after the addition of polymer. That is, a single washer with polymer can operate with almost the same effectiveness as two washers in series without polymer.

Systems Analysis

In order to evaluate the effect of polymer addition at the first washer on the efficiency of the whole wash room, it is necessary to characterize the efficiency of the other washers. The operating conditions of the other washers at Cosmopolis were measured during the mill trial of Example 3 and these data enabled the washing efficiencies of the other washers to be calculated. The results are presented in Table B together with the corresponding values for E.

TABLE B

Operating Data for Cosmopolis Washer Two, Three and Decker

| Washer Identity | Speed, RPM | Through-put, TPH | Vacuum, mm Hg | Vat Cons, % | Drum Cons, % | Inlet Solids, % | Wash Solids, % | Outlet Solids, % | Temp., °C. | Nordeen Factor |
|---|---|---|---|---|---|---|---|---|---|---|
| Two | 2.2 | 20 | 265 | 0.8 | 10.9 | 10.5 | 6.2 | 8.3 | 55 | 2.04 |
| Three | 2.3 | 20 | 230 | 1.0 | 12.5 | 6.8 | 3.4 | 4.5 | 48 | 3.55 |
| Decker | 2.7 | 20 | — | 1.4 | 14.0 | 3.7 | 0.0 | 1.3 | 48 | 2.82 |

The overall Nordeen efficiency factor for the four washers in series is simply the sum of the individual Nordeen efficiency factors. The overall Nordeen efficiency factor for the four washers without polymer is 6.4+2.0+3.6+2.8=14.8. The overall steady-state efficiency is expected to be increased to 11.5+2.0+3.6+2.8=19.9 if polymer were to be added to the first washer. This represents a 34% increase in the overall wash room efficiency. A 25% increase in overall efficiency would be equivalent to adding another washer in series to the existing washers.

The increased washing efficiency could be used either to increase the overall chemical recovery and reduce the carryover of dissolved solids at the same dilution factor, or to decrease the load on the evaporator and energy consumption by reducing dilution factor while maintaining the same solids recovery.

Decreased Dilution Factor

This analysis assumes that the consistencies of the pulp streams entering and leaving the wash room are equal. Under these conditions, $L_{pi}=L_{po}$ and $L_{li}=L_{lo}$ and a simple relationship between displacement ration, Y, Nordeen Efficiency Factor and wash liquor ratio, W, can be deduced from the definition of displacement ratio and equation (1):

$$Y = 1 - \frac{W - 1}{W^{E+1} - 1} \quad (3)$$

$$\text{where } W = \frac{L_{lo}}{L_{pi}} = 1 + \frac{DF \times C}{(1 - C)}$$

$DF$ = dilution factor
$C$ = consistency

When the dilution factor equals zero, equation (3) becomes indeterminant and equation (4), which can be deduced from equation (2) applies:

$$Y = \frac{E}{E-1} \quad (4)$$

Substituting the normal dilution factor at Cosmopolis of 1.37 and the value of 14.8 for the Nordeen Efficiency Factor corresponding to normal operation without polymers, into equation (3) gives a value for the overall displacement ratio for all the washers of 97.9%. In other words, 6.3% of the washable solids is being carried over in the pulp stream. Substituting the value of 19.3 for the Nordeen Efficiency Factor corresponding to operation with polymer, and the value for the overall displacement ratio of 97.9% into equation (3) gives a dilution factor of 0.74. This is the dilution factor required with polymer to achieve the same displacement ratio.

The addition of polymer is expected to reduce the overall dilution factor by 0.63 ton of water per ton of pulp. This represents an appreciable reduction in demand for both evaporator capacity and energy.

Increased Chemical Recovery

Substituting the value for the overall Nordeen Efficiency Factor corresponding to polymer addition at the first washer, 19.9, and a dilution factor value of 1.37 into equation (4) gives an overall displacement ratio for washable solids of 99.0%. That is, if the dilution factor is not changed, the carryover of washable solids is expected to be reduced from 2.1% to 1.0% through the use of polymer. A 50% reduction in carry-over represents an appreciable reduction in the demand for bleaching chemicals, and in the color and BOD of mill effluent.

Cost of Polymer

The DOW XD-30150-00 polymer used in this trial currently sells in bulk for $3.50 per kilogram or $1.60 per pound (1979 dollars). The number one brownstock washer at Cosmopolis operating at a dilution factor of zero would consume one kilogram of polymer per hour if polymer were to be added at a concentration of 6 ppm in the wash fluid. Consequently, the cost of adding polymer to the number one washer would be $3.50 per hour or 17.5 cents per oven-dried ton of pulp.

A number of polymers, primarily affecting permeability behavior, will accomplish the mobility reducing effect on displacement solutions. An ultra high molecular weight polymer, having a MW of at least about 1,000,000 is especially useful. Stability of the compound is usually not a critical criteria since the chemical may be injected into the wash water stream just prior to flow into the washers. Subsequent destruction due to shear stresses in pumping is of little consequence at the low addition rates involved. It is postulated that a characteristic of the polymer sought is the ability of the polymer to hydrate or "uncoil" in a particular media-liquor environment. This uncoiling is thought to produce the resistance to flow through the tortuous pathways in the porous media.

The following is a list of polymers, which either alone or in combination have the desired effect of improving washer efficiency: polyethylene oxide; polyacryl amide; polyvinyl pyprolidone; polyacrylic acid; polymethacrylic acid; carboxymethyl cellulose-Na, K, Li, amine salts; alginic acid, K, Na, Li, amine salts; polymaleic acid; and copolymers of two or more of the following monomers: methacrylic acid, acrylic acid, acryl acid, acrylamide, vinyl pyprolidone, maleic anhydride, styrene sulphonate (Na, K, Li, salts), vinyl ether, methacryl amide, vinyl acetate (alcohol), ethylene oxide; polyvinyl alcohol; methyl cellulose; hydroethyl/propyl cellulose; starch; starch/PAN; poly styrene sulphonate, (Na, K, Li, ammonia salts), polyvinyl sulphonate (k, Na, Li, ammonia salt), carageenan, cellulose sulphate (Na, K, Li, ammonia, amine salt), polyvinyl pyridine and quarternized pyridinius salts, deacetylated karaya gum, chitosan, guar gum and locust bean gum.

The process is effective in either acid or alkali systems. A non-ionic polymer is appropriate for acid systems while an ionic polymer is used in alkali systems. The washing improvements are not equipment limited. The process is useful with ring diffusers, kamyr diffusers, blow pits and the like. The process is also useful in bleaching operations where uniformity of the results is improved. Other uses, such as separations of aqueous and non-aqueous liquids; for example, the separation of oils from vegetable matter is within the scope of the invention as will be apparent to those skilled in the art.

What is claimed is:

1. In a process for separating a liquid from an insoluble material which includes the steps of thickening said insoluble material by draining excess liquid therefrom while retaining the material in a porous formation on a porous support means and displacing a substantial portion of the liquid remaining in the insoluble porous material after thickening from said material by injecting a wash liquid into said material, without substantially disturbing said porous formation of the retained material, the improvement, comprising:

reducing the mobility of said wash liquid in the porous formation of the insoluble material with respect to the mobility of said liquid originally retained in the porous insoluble material, wherein the mobility of a liquid with respect to a porous formation is proportional to the permeability of the porous formation to a liquid and inversely proportional to the viscosity of said liquid, such that the ratio of wash liquid mobility to the mobility of the liquid to be displaced is about 0.05–2.0.

2. The process of claim 1, wherein: reducing the mobility of said wash liquid is accomplished by increasing its viscosity relative to said liquid to be displaced.

3. The process of claim 2, wherein: the viscosity of said wash liquid is increased by reducing the temperature of said wash liquid below ambient temperature, thereby reducing its mobility relative to said liquid to be displaced.

4. The process of claim 2, wherein: the viscosity of said wash liquid is increased by adding starch to said solution, thereby reducing the mobility of said wash liquid relative to said liquid to be displaced.

5. The process of claim 1, wherein: reducing the mobility of said wash liquid is accomplished by reducing the effective permeability of said liquid with respect to the porous formation of insoluble material by adding a polymer to said liquid to form a wash solution.

6. The process of claim 1, wherein: reducing the mobility of said wash liquid is accomplished by adding liquid-soluble polymers thereto, said polymers characterized by their hydrating ability at very low concentrations.

7. The process of claim 6, wherein: the mobility of the wash solution is adjusted by adding said polymer in an amount such that the ratio of wash solution mobility to the mobility of the solution to be displaced is about 0.05–2.0.

8. The process of claim 6, wherein: the mobility of wash solution is adjusted by adding said polymer in an amount such that the mobility ratio is about 0.2–1.0.

9. The process of claim 6, wherein: said mobility reducing polymers are one or more homo or copolymers of ethylene oxide, acrylamide, vinyl pyprolidone, acrylic acid, methacrylic acid, the Na, K, Li and amine salts of carboxymethyl cellulose, maleic acid, Na, K, Li and amine salts of alginic acid.

10. The process of claim 9, wherein: the mobility of the wash solution is adjusted by said polymer having a molecular weight of greater than 1 million.

11. The process of claim 6, wherein: said mobility reducing polymers are one or more homo or copolymers of acrylamide, acrylic acid, carboxymethylene or deacetylated chitin.

12. An improved process for displacement washing of pulp substantially free of soluble contaminants, wherein said pulp is first thickened and retained on a porous supporting means, comprising:

preparing a wash solution, in which the fiber is insoluble and having a concentration therein of said contaminants to be removed less than that of the pulp to be washed;

adjusting the apparent, effective mobility of said wash solution such that the ratio of wash solution mobility to the mobility of the solution to be recovered is about 0.05 to 2.0, wherein the mobility of each solution is proportional to the permeability of the pulp with respect to that solution and inversely proportional to the viscosity of said solution; and injecting the pulp with said wash solution, wherein the solution containing the dissolved solids is preferentially displaced.

13. The process of claim 12 wherein the solution to be displaced is spent cooking liquor from a pulping process.

14. The process of claim 12 wherein the soluble contaminants of the solution to be displaced are dissolved solids from the bleaching of pulp.

15. The process of claim 12 wherein the mobility of the wash solution is adjusted by adding a high molecular weight polymer that is soluble in the wash solution solvent.

16. The process of claim 15 wherein said polymers are one or more homo or copolymers of ethylene oxide, acrylamide, vinyl pyprolidone, acrylic acid, methacrylic acid, or Na, K, Li and amine salts of carboxymethyl cellulose.

17. The process of claim 16 wherein the high molecular weight polymer has a molecular weight greater than 1 million.

18. The process of claim 12 wherein the ratio of the mobility of the wash solution to that of the solution to be displaced is about 0.2–1.0.

19. The process of claim 12 wherein said polymer is added in an amount of 2–50 ppm to the wash solution.

20. The process of claim 19 wherein said polymer is polyacrylamide, carboxypolymethylene, or deacetylated chitin.

21. An improved process for recovering processing chemicals from wood pulp retained in solution with the pulp after the pulp has been thickened, by displacement washing of said pulp, the improvement, comprising:

preparing a wash solution, said solution having a lower concentration of the chemicals to be displaced than that initially retained with said pulp;

adding to said solution a polymer having a molecular weight greater than 1 million, wherein said polymer is polyacrylamide, carboxypolymethylene, or deacetylated chitin, in an amount of about 2–50 ppm such that the apparent, effective ratio of wash solution mobility to the mobility of the chemical solution to be recovered is about 0.05 to 2.0 wherein the mobility of each solution is proportional to the permeability of the pulp with respect to that solution and inversely proportional to the viscosity of said solution;

injecting into said pulp said wash solution; and recovering said wash solution containing said chemicals.

22. The process of claim 21 wherein said displacement wash solution is employed on rotary cylinder vacuum washers.

23. The process of claim 21 wherein said displacement wash solutions is employed in a ring diffuser washer.

* * * * *